US009147570B2

(12) United States Patent
Meyer

(10) Patent No.: US 9,147,570 B2
(45) Date of Patent: Sep. 29, 2015

(54) ELECTRODELESS LAMP

(75) Inventor: Andreas Meyer, Fechy (CH)

(73) Assignee: LUMATRIX SA, Aubonne (CH)

( * ) Notice: Subject to any disclaimer, the term of this patent is extended or adjusted under 35 U.S.C. 154(b) by 30 days.

(21) Appl. No.: 14/005,699

(22) PCT Filed: Mar. 18, 2011

(86) PCT No.: PCT/EP2011/054168
§ 371 (c)(1),
(2), (4) Date: Nov. 19, 2013

(87) PCT Pub. No.: WO2012/126505
PCT Pub. Date: Sep. 27, 2012

(65) Prior Publication Data

US 2014/0117848 A1 May 1, 2014

(51) Int. Cl.

| | |
|---|---|
| ***H01J 61/16*** | (2006.01) |
| ***H01J 65/04*** | (2006.01) |
| ***H01J 61/12*** | (2006.01) |

(52) U.S. Cl.
CPC ..... *H01J 65/042* (2013.01); *H01J 61/125* (2013.01); *H01J 65/044* (2013.01)

(58) Field of Classification Search
USPC ..... 313/643
See application file for complete search history.

(56) References Cited

U.S. PATENT DOCUMENTS

| | | | |
|---|---|---|---|
| 3,202,811 | A | 8/1965 | Hall, Jr. |
| 5,606,220 | A | 2/1997 | Dolan et al. |
| 5,866,981 | A | 2/1999 | Saimi et al. |
| 5,972,442 | A | 10/1999 | Anderson et al. |
| 6,469,444 | B1 | 10/2002 | Leng et al. |
| 6,633,111 | B1 | 10/2003 | Kim et al. |
| 7,431,466 | B2 | 10/2008 | Lee et al. |
| 2004/0021420 | A1 | 2/2004 | Tsuda et al. |
| 2010/0073011 | A1 | 3/2010 | Svidenko et al. |
| 2010/0117533 | A1 | 5/2010 | Koerber et al. |

FOREIGN PATENT DOCUMENTS

| | | |
|---|---|---|
| GB | 1552334 | 9/1979 |
| WO | 2008/120171 A2 | 10/2008 |
| WO | 2010/044020 A2 | 4/2010 |

OTHER PUBLICATIONS

International Search Report for PCT/EP2011/054168 dated Aug. 2, 2011.

*Primary Examiner* — Mariceli Santiago
*Assistant Examiner* — Brenitra M Lee
(74) *Attorney, Agent, or Firm* — Pearne & Gordon LLP

(57) ABSTRACT

An electrodeless discharge lamp suitable for the use in solar simulators, with an emission spectrum following, as much as possible, the AM1.5G standard. According to a preferred embodiment the lamp has a quartz bulb is filled with a composition comprising an inert gas, for example $N_2$, He, Ne, Ar, Kr, Xe or a mixture thereof, and a first and a second active components, the first active component being an antimony or bismuth halide or a mixture of antimony halides; while the second component is $SnI_2$ a mixture of halides of: In, Sn, Ag, Bi, Cu. Preferably, the halides are bromides or iodides or chlorides due to their favorable volatilities.

10 Claims, 2 Drawing Sheets

ELECTRODELESS LAMP

FIELD OF THE INVENTION

The present invention is related to discharge lamps, in particular discharge lamps that are used to simulate solar light, and to the use of such lamps as sources in test characterisation of photovoltaic systems.

DESCRIPTION OF RELATED ART

High intensity discharge lamps (HID lamps) form one of the most widely used forms of lighting. An electrodeless lamp is a form of discharge lamp in which the discharge is obtained at the interior of a sealed transparent bulb by use of a RF or microwave energy. The bulbs in electrodeless lamps include a chemically inert gas and one or more active components, like for example mercury, sulphur, tellurium, or metal halides.

Electrodeless lamps tend to have a longer lifetime and to maintain uniform spectral characteristics along their life than electrode discharge lamps. While requiring a radiofrequency power supply, they use bulbs of very simple structure, without costly glass-metal interfaces. Moreover, they can use filling compositions that would be chemically incompatible with metals electrodes.

Many HID lamps are filled with a composition containing mercury. This is advantageous for what the light emission is concerned, mercury, however, is a toxic and environmentally hazardous substance, and it is expected that its use will be limited or phased out in the future. Other variants are known for the composition used to fill the bulb of an electrodeless lamp. A fill containing selenium or sulphur is known from U.S. Pat. No. 5,606,220, and U.S. Pat. No. 6,633,111 describes a fill comprising $SnI_2$. WO08120171A and U.S. Pat. No. 6,469,444B disclose a fill with sulphur in association with antimony halides. U.S. Pat. No. 5,866,981 discloses a composition comprising rare earth and metal halides such as antimony iodide ($SbI_3$) or indium iodide, while WO10044020, US2010117533 describe a fill including to monoxide compounds and metal halides. These documents are generally concerned with lamps for general illumination applications, and strive to produce a fill that delivers high luminous efficiency and colour rendition.

Test and characterisation of photovoltaic systems are carried out, with solar simulators that include light sources designed to simulate the characteristics of natural solar illumination. It is desirable, to ensure exact and repeatable test results, that the simulated solar light should match the intensity and spectrum of solar light, as it is received at the surface of earth. There exist several international standards aiming to regulate and standardise the spectral characteristics of solar simulators, for example IEC60904, ASTMG173 and 1509845-1, as well as the testing protocols for photovoltaic elements, like IEC601215, IEC61646. These standards prescribe, for example, that photovoltaic systems used for terrestrial applications at fixed orientation should be tested with an illumination following, within prescribed tolerances, the AM1.5G spectrum given in table 1.

In the art, it is known to use Xenon discharge lamps, or different combinations of discharge lamps and halogen lamps to provide an emission spectrum that closely matches the solar illumination. In some cases, the match can be improved by the use of appropriate filters. U.S. Pat. No. 3,202,811, US20100073011 and U.S. Pat. No. 7,431,466 describe examples of solar simulators of this kind.

These solar simulators provide a light with a spectrum that matches the solar emission, but at the cost of combining several sources and filters. It is desirable, therefore, a lamp that could directly generate a light that matches closely the sun spectrum in a form that is more compact, economical, and energy efficient than the solutions of the state of the art.

BRIEF SUMMARY OF THE INVENTION

According to the invention, these aims are achieved by means of the lamp that is the object of the independent claim, while dependent claims relate to preferred embodiments and useful variants.

BRIEF DESCRIPTION OF THE DRAWINGS

The invention will be better understood with the aid of the description of an embodiment given by way of example and illustrated by the figures, in which.

DETAILED DESCRIPTION OF POSSIBLE EMBODIMENTS OF THE INVENTION

Figure 1:
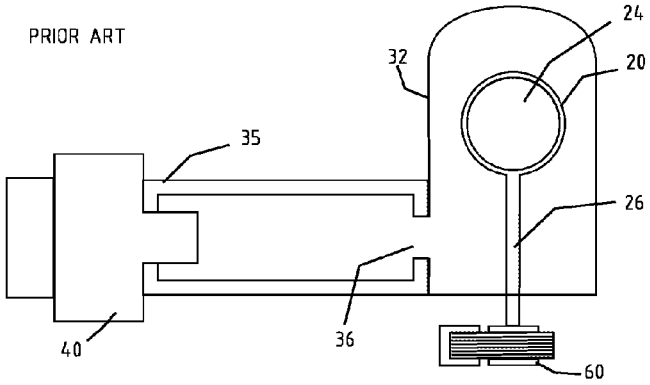
FIG. 1 is a conceptual simplified representation of a discharge lamp according to an embodiment of the invention.

Plasma lamps are per se known in the art, and their structure and manufacture will be discussed here summarily. FIG. 1 illustrates a possible structure of a discharge lamp suitable to embody the invention. The lamp includes a transparent sealed bulb 20, enclosing a volume 24 that is filled with a suitable fill composition, as it will be seen in the following. The bulb 20 is placed in an electromagnetic enclosure 32 to which radiofrequency energy is supplied, in order to bring the fill to a light- and infrared-radiating plasma state.

In a typical realization a magnetron 40 generates a radiofrequency signal of appropriate intensity, and is coupled to the cavity 32 by waveguide 35 and opening 36. This variant is advantageous because magnetrons emitting in the open 2.45 GHz band with powers of the order of 1 kW are readily available at attractive prices, but the invention could be realized with any suitable means for coupling excitation power into the bulb to generate a light- and infrared-radiating plasma within the bulb. The invention could use, for example, a solid-state RF source in the UHF band or at other frequencies, for example in the LF or HF bands. It would also be conceivable to insert electrodes into the bulb, and transfer energy to the fill by an electric discharge.

The present invention is not limited to a specific coupling arrangement either. The waveguide 35 and opening 36 could in fact take any suitable form. In a possible variant the waveguide 35 could be suppressed entirely, and the magnetron or the RF source coupled directly to the enclosure 32. According the frequency of the excitation radiation, the coupling could include magnetic elements, ferrite cores or the like.

The purpose of electromagnetic enclosure 32 is to confine the radiofrequency field and concentrate it on the bulb 20. In embodiments of the invention, however, the enclosure 32 could be suppressed: for example if the lamp is fully enclosed in a larger system. In other cases the enclosure could include light reflecting and light transmitting surfaces, in order to project a light beam. In typical instances, the enclosure 32 may be an electromagnetic cavity tuned to the magnetron's frequency, whose walls are made of conductive mesh or perforated metal, in order to concentrate RF energy on the bulb 20 while letting the light out.

Optionally, the electric motor 60 is used to drive the bulb in rotation by the insulating stem 26. This is useful to prevent the formation of hot spots on the surface of the bulb itself.

The bulb itself is preferably made of quartz, or of any suitable transparent material capable to stand high operating temperatures, for example of 600-900° C., and chemically compatible with the fill. According to the desired power, the size of the bulb may vary between 0.5 $cm^3$ and 100 $cm^3$, typically around 10-30 $cm^3$. As to the filling pressure, the bulb is typically filled at a pressure of 10-100 hPa at standard temperature, the pressure at operation being for example comprised between 0.1 MPa and 2 MPa (1 and 20 bar absolute).

The present invention aims to provide a discharge lamp suitable for the use in solar simulators, with an emission spectrum following, as much as possible, the AM1.5G standard. With respect to conventional illumination applications, the spectrum of the lamp of the invention follows more closely the sun in the red and infrared, for example in the region between 700 and 1000 nm. These wavelengths do not add much to the perceived illumination level and colours, but contribute significantly to the thermal and electrical behaviour of photovoltaic cells and panels. The source of the present invention is also suitable to simulate other spectrum standard, like for example AMG1.0.

According to a preferred embodiment of the invention, the bulb is filled with a composition comprising an inert gas, for example $N_2$, He, Ne, Ar, Kr, Xe or a mixture thereof, and a first and a second active components, the first active component being an antimony or bismuth halide or a mixture of antimony halides; while the second component is preferably $SnI_2$, but also other halides or a mixture of halides of: In, Sn, Ag, Bi, Cu have proven valid alternatives. Preferably, the halides are bromides or iodides or chlorides due to their favourable volatilities.

Experimentation has shown that this composition provide an emission matching closely the standard solar spectrum, and good overall efficiency. Antimony fills have proved somewhat superior in these respects than bismuth fills.

It has also been found that the spectral match can be improved by adding an additional active component like metallic indium, or, in alternative, copper or silver.

The concentration of active components in the bulb can vary between 0.1 and 5 and mg/cm3. Best results are obtained at concentrations between 0.5 and 2 mg/cm3. As to the gaseous part, good ignition of the discharge has been obtained with filling pressures of about 30 mbar at atmospheric pressure. The tests have used, with equivalent results: pure argon, Ar/Xe mixtures, or other inert gases.

Example I

According to a first example, the bulb 20 is a quartz spherical vessel of 15.6 $cm^3$ internal volume, and it is filled as follows:

| | |
|---|---|
| $SbBr_3$ | 10 mg |
| $SnI_2$ | 7 mg |
| In(metallic) | 7 mg |
| Ar | 30 mbar at 25° C. |

Figure 2:
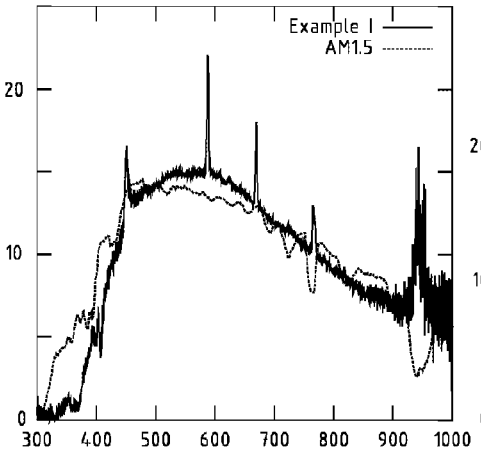
FIGS. 2 to 7 show emission spectra of discharge lamps according to various examples and embodiments of the invention. The relative light intensity, in ordinates, is plotted against the wavelength in nm. The emission spectra are superposed to a standard AM1.5G solar spectrum (dashed line).

The bulb is inserted in a lamp having the structure of FIG. 1, spun at 3000 rpm and excited by a microwave source at 2.45 GHz and 720 W. The emission spectrum obtained is shown in FIG. 2. The temperature of the bulb, measured by a FLIR camera, was 678° C. This combination provides an excellent spectrum and good efficiency.

Example II

According to another example, an identical quartz bulb of 15.6 $cm^3$ internal volume, it is filled as follows:

| | |
|---|---|
| $BiBr_3$ | 10 mg |
| SnI2 | 5 mg |
| In(metallic) | 5 mg |
| Ar | 30 mbar at 25° C. |

Figure 3:
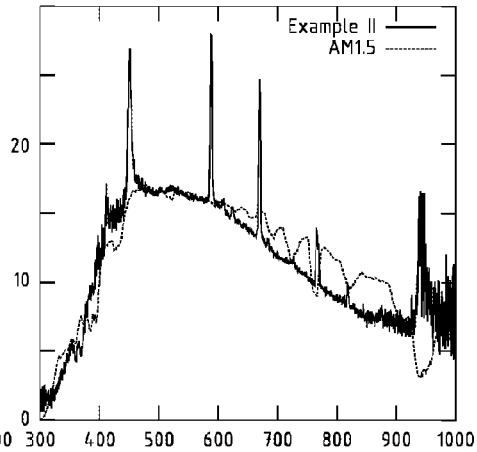

The bulb is inserted in a lamp having identical to that of example I and excited by a microwave source at 2.45 GHz and 828 W. The emission spectrum obtained is shown in FIG. 3. The temperature of the bulb, not spinning in this test, was 810° C. The spectrum shows higher peaks above the continuous component, and matches the solar distribution somewhat worse than the one in example I.

Example III

According to another example, an identical quartz bulb of 15.6 $cm^3$ internal volume, it is filled as follows:

| | |
|---|---|
| $BiBr_3$ | 10 mg |
| In(metallic) | 10 mg |
| Ar | 30 mbar at 25° C. |

Figure 4:
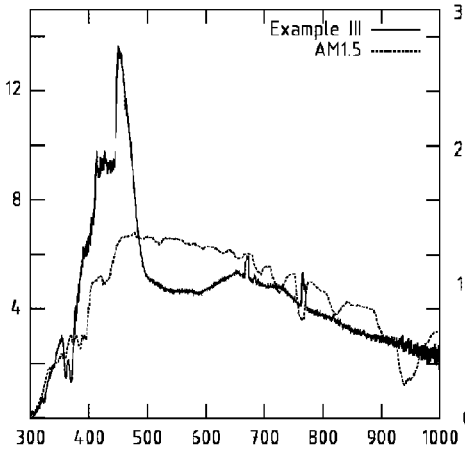

The bulb is inserted in a lamp having identical to that of example I, spun at 3000 rpm and excited by a microwave source at 2.45 GHz and 795 W. The emission spectrum obtained is shown in FIG. 4. The temperature of the bulb was not measured. In term of spectral quality, this fill is clearly less satisfactory than the antimony fill of example I.

Example IV

According to another example, an identical quartz bulb of 15.6 $cm^3$ internal volume, it is filled as follows:

| | |
|---|---|
| $SbBr_3$ | 15 mg |
| In(metallic) | 10 mg |
| Ar | 30 mbar at 25° C. |

Figure 5:
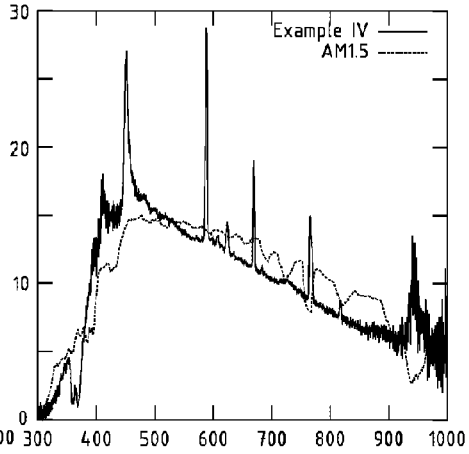

The bulb is inserted in a lamp having identical to that of example I, spun at 3000 rpm and excited by a microwave source at 2.45 GHz and 700 W. The emission spectrum obtained is shown in FIG. 5. The temperature of the bulb was 663° C. The match with the solar spectrum is fair, but inferior to that of example I.

Example V

According to another example, an identical quartz bulb of 15.6 $cm^3$ internal volume, it is filled as follows:

| | |
|---|---|
| $SbBr_3$ | 14 mg |
| $SnI_2$ | 5 mg |
| In(metallic) | 9 mg |
| Ar | 30 mbar at 25° C. |

Figure 6:
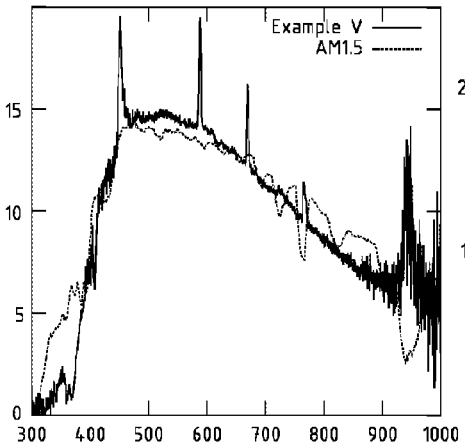

The bulb is inserted in a lamp having identical to that of example I, spun at 3000 rpm and excited by a microwave source at 2.45 GHz and 720 W. The emission spectrum obtained is shown in FIG. 6. The temperature of the bulb was 652° C. This fill is qualitatively the same to that of example I, with different proportions, and also yielded an excellent spectrum.

Example VI

According to another example, an identical quartz bulb of 15.6 $cm^3$ internal volume, it is filled as follows:

| | |
|---|---|
| $SbBr_3$ | 10 mg |
| $InCl_3$ | 10 mg |
| In(metallic) | 7 mg |
| Ar | 30 mbar at 25° C. |

Figure 7:
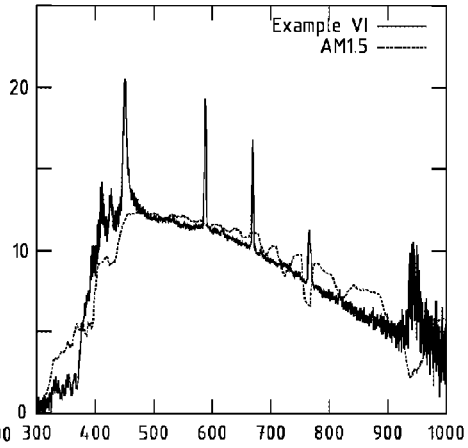

The bulb is inserted in a lamp having identical to that of example I, spun at 3000 rpm and excited by a microwave source at 2.45 GHz and 735 W. The emission spectrum obtained is shown in FIG. 7. The temperature of the bulb was 791° C. In this case the substitution of $InCl_3$ for $SnI_2$ still gives a good spectrum, but a lower intensity.

TABLE 1

| AM1.5G spectrum | |
|---|---|
| λ [nm] | intensity |
| 305 | 0.005833231 |
| 310 | 0.025973229 |
| 315 | 0.066191821 |
| 320 | 0.111138401 |
| 325 | 0.151602603 |
| 330 | 0.242785214 |
| 335 | 0.239592288 |
| 340 | 0.267346187 |
| 345 | 0.269556674 |
| 350 | 0.297064964 |
| 360 | 0.319538254 |
| 370 | 0.409185804 |
| 380 | 0.43761513 |
| 390 | 0.442650129 |
| 400 | 0.622190839 |
| 410 | 0.711285767 |
| 420 | 0.727188997 |
| 430 | 0.658295469 |
| 440 | 0.799643866 |
| 450 | 0.937185313 |
| 460 | 0.982377502 |
| 470 | 0.97095665 |
| 480 | 1 |
| 490 | 0.945290434 |
| 500 | 0.951123664 |
| 510 | 0.974333784 |
| 520 | 0.911948913 |
| 530 | 0.965676041 |
| 540 | 0.952351713 |
| 550 | 0.958983176 |
| 570 | 0.922141717 |
| 590 | 0.857055139 |
| 610 | 0.912194523 |
| 630 | 0.880756478 |
| 650 | 0.87197593 |
| 670 | 0.855028859 |
| 690 | 0.693970281 |
| 710 | 0.808670023 |
| 718 | 0.620471571 |
| 724.4 | 0.640672971 |
| 740 | 0.743829056 |
| 752.5 | 0.733206435 |
| 757.5 | 0.721908388 |
| 762.5 | 0.39494044 |
| 767.5 | 0.632997667 |

TABLE 1-continued

| AM1.5G spectrum | |
|---|---|
| λ [nm] | intensity |
| 780 | 0.694645708 |
| 800 | 0.664251504 |
| 816 | 0.521552253 |
| 823.7 | 0.48207049 |
| 831.5 | 0.562814687 |
| 840 | 0.589524745 |
| 860 | 0.601191207 |
| 880 | 0.573130296 |
| 905 | 0.459720005 |
| 915 | 0.409922633 |
| 925 | 0.42398379 |
| 930 | 0.247881616 |
| 937 | 0.158602481 |
| 948 | 0.192558025 |
| 965 | 0.323529412 |
| 980 | 0.397028122 |
| 993.5 | 0.458614761 |
| 1040 | 0.424106595 |
| 1070 | 0.391501903 |
| 1100 | 0.253346433 |
| 1120 | 0.06692865 |
| 1130 | 0.116111998 |
| 1137 | 0.081174014 |
| 1161 | 0.208215645 |
| 1180 | 0.282512587 |
| 1200 | 0.2601007 |
| 1235 | 0.295100086 |
| 1290 | 0.253714847 |
| 1320 | 0.153628884 |
| 1350 | 0.01995579 |
| 1395 | 0.000982439 |
| 1442.5 | 0.034201154 |
| 1462.5 | 0.064533956 |
| 1477 | 0.064779565 |
| 1497 | 0.111813828 |
| 1520 | 0.161304188 |
| 1539 | 0.16842687 |
| 1558 | 0.168856687 |
| 1578 | 0.150190348 |
| 1592 | 0.151909616 |
| 1610 | 0.140427361 |
| 1630 | 0.150128945 |
| 1646 | 0.144234312 |
| 1678 | 0.135392362 |
| 1740 | 0.105366573 |
| 1800 | 0.018850546 |
| 1860 | 0.001228049 |
| 1920 | 0.000736829 |
| 1960 | 0.013017315 |
| 1985 | 0.055937615 |
| 2005 | 0.016455852 |
| 2035 | 0.061095419 |
| 2065 | 0.037087069 |
| 2100 | 0.054709566 |
| 2148 | 0.050472799 |
| 2198 | 0.043902739 |
| 2270 | 0.043165909 |
| 2360 | 0.03813091 |
| 2450 | 0.013017315 |
| 2494 | 0.01135945 |
| 2537 | 0.001964878 |
| 2941 | 0.002701707 |
| 2973 | 0.004666585 |
| 3005 | 0.003991158 |
| 3056 | 0.001964878 |
| 3132 | 0.003315731 |
| 3156 | 0.011912072 |
| 3204 | 0.000798232 |
| 3245 | 0.001964878 |
| 3317 | 0.008043719 |
| 3344 | 0.001964878 |
| 3450 | 0.008166523 |
| 3573 | 0.007306889 |
| 3765 | 0.006017438 |
| 4045 | 0.004605182 |

What is claimed is:

1. A discharge lamp for providing visible and infrared radiation, comprising a light transmitting bulb containing a fill comprising:

an inert gas among $N_2$, He, Ne, Ar, Kr, Xe or a mixture thereof, a first active component consisting of antimony halide or of bismuth halide or of a mixture of antimony and bismuth halides, a second active component, consisting in a halide or in a mixture of halides of one or more of: In, Sn, Ag, Cu, optional additional active components, whose cumulative mass does not exceed the summed masses of said first active component and said second active component, wherein said first active component and said second active component each has a concentration in a range of 0.1 and 5 and mg/cm$^3$.

2. The lamp of the previous claim, wherein the additional active component includes metallic indium.

3. The lamp of claim 1, wherein the first active component is an antimony halide or antimony bromide.

4. The lamp of claim 1, wherein the second active component is tin iodide or indium chloride.

5. The lamp of claim 1, further having means for coupling excitation power into the bulb to generate a light- and infrared-radiating plasma within the bulb.

6. The lamp of claim 1, wherein said halides are bromides and/or iodides.

7. The lamp of claim 1, wherein said first active component and said second active component each has a concentration in a range of 0.5 and 2 mg/cm$^3$.

8. The lamp of claim 1, wherein said first active component consists of antimony tribromide, bismuth tribromide, or of a mixture of antimony tribromide and bismuth tribromide.

9. The lamp of claim 1, wherein the lamp includes no electrodes.

10. A discharge lamp for providing visible and infrared radiation, comprising a light transmitting bulb containing a fill, comprising:

an inert gas among $N_2$, He, Ne, Ar, Kr, Xe or a mixture thereof;

a first active component consisting of antimony halide or of bismuth halide or of a mixture of antimony and bismuth halides;

a second active component, consisting in a halide or in a mixture of halides of one or more of: In, Sn, Bi, Ag, Cu; and additional active components comprising metallic indium, a cumulative mass of the additional active components not exceeding summed masses of said first active component and said second active component.

* * * * *

UNITED STATES PATENT AND TRADEMARK OFFICE

CERTIFICATE OF CORRECTION

PATENT NO. : 9,147,570 B2
APPLICATION NO. : 14/005699
DATED : September 29, 2015
INVENTOR(S) : Andreas Meyer It is certified that error appears in the above-identified patent and that said Letters Patent is hereby corrected as shown below:

On the title page,

Under (73) Assignee, please replace "LUMATRIX SA" with -- LUMARTIX SA --

In the specification,

Column 1, line 53, please replace "1509845-1" with -- ISO9845-1 --

Signed and Sealed this
Seventh Day of June, 2016

Michelle K. Lee

Michelle K. Lee
*Director of the United States Patent and Trademark Office*